US007624766B2

(12) United States Patent
Ward

(10) Patent No.: US 7,624,766 B2
(45) Date of Patent: Dec. 1, 2009

(54) WARPED STITCHED PAPERMAKER'S FORMING FABRIC

(75) Inventor: Kevin J. Ward, Colbrook (CA)

(73) Assignee: Weavexx Corporation, Wake Forest, NC (US)

( * ) Notice: Subject to any disclaimer, the term of this patent is extended or adjusted under 35 U.S.C. 154(b) by 146 days.

(21) Appl. No.: 11/687,006

(22) Filed: Mar. 16, 2007

(65) Prior Publication Data

US 2008/0223474 A1 Sep. 18, 2008

(51) Int. Cl.

| | |
|---|---|
| ***D03D 3/04*** | (2006.01) |
| ***D21F 1/10*** | (2006.01) |
| ***D21F 7/08*** | (2006.01) |
| *D03D 25/00* | (2006.01) |

(52) U.S. Cl. ..... 139/383 A; 139/383 R; 162/358.2

(58) Field of Classification Search ..... 139/383 R, 139/383 A, 383 AA, 408, 411, 413, 414; 162/348, 358.1, 358.2, 900, 902, 903, 904
See application file for complete search history.

(56) References Cited

U.S. PATENT DOCUMENTS

| | | | |
|---|---|---|---|
| 2,172,430 | A | 9/1939 | Barrell |
| 2,554,034 | A | 5/1951 | Koester et al. |
| 3,094,149 | A | 6/1963 | Keily |
| 3,325,909 | A | 6/1967 | Clark |
| 4,093,512 | A | 6/1978 | Fleischer |
| 4,182,381 | A | 1/1980 | Gisbourne |
| 4,244,543 | A | 1/1981 | Ericson |
| 4,289,173 | A | 9/1981 | Miller |
| 4,290,209 | A | 9/1981 | Buchanan et al. |
| 4,414,263 | A | 11/1983 | Miller et al. |
| 4,438,788 | A | 3/1984 | Harwood |
| 4,452,284 | A | 6/1984 | Eckstein et al. |
| 4,453,573 | A | 6/1984 | Thompson |
| 4,501,303 | A | 2/1985 | Osterberg |

(Continued)

FOREIGN PATENT DOCUMENTS

| | | |
|---|---|---|
| DE | 454 092 | 12/1927 |

(Continued)

OTHER PUBLICATIONS

International Search Report and The Written Opinion for PCT/US2008/003011, dated Jul. 4, 2008.

(Continued)

*Primary Examiner*—Bobby H Muromoto, Jr.
(74) *Attorney, Agent, or Firm*—Myers Bigel Sibley & Sajovec

(57) ABSTRACT

A papermaker's fabric includes a plurality of repeat units of interwoven yarns, each repeat unit comprising: a set of top MD yarns; a set of top CMD yarns interwoven with the top MD yarns; a set of bottom MD yarns; and a set of bottom CMD yarns interwoven with the bottom MD yarns. In interweaving with the top CMD yarns, some of the top MD yarns include a segment in which the top MD yarn passes below a subset of three consecutive top CMD yarns. Each of the bottom MD yarns forms a knuckle over one of the three top CMD yarns of the subset that a top MD yarn located immediately thereabove passes below. The set of bottom CMD yarns includes at least twice as many yarns as does the set of bottom MD yarns.

8 Claims, 4 Drawing Sheets

U.S. PATENT DOCUMENTS

| | | | | | |
|---|---|---|---|---|---|
| 4,515,853 | A | | 5/1985 | Borel | |
| 4,529,013 | A | | 7/1985 | Miller | |
| 4,564,052 | A | | 1/1986 | Borel | |
| 4,564,551 | A | | 1/1986 | Best | |
| 4,592,395 | A | | 6/1986 | Borel | |
| 4,592,396 | A | | 6/1986 | Borel et al. | |
| 4,605,585 | A | | 8/1986 | Johansson | |
| 4,611,639 | A | | 9/1986 | Bugge | |
| 4,621,663 | A | | 11/1986 | Malmendier | |
| 4,633,596 | A | | 1/1987 | Josef | |
| 4,636,426 | A | | 1/1987 | Fleischer | |
| 4,642,261 | A | | 2/1987 | Fearnhead | |
| 4,676,278 | A | | 6/1987 | Dutt | |
| 4,705,601 | A | | 11/1987 | Chiu | |
| 4,709,732 | A | | 12/1987 | Kinnunen | |
| 4,729,412 | A | | 3/1988 | Bugge | |
| 4,731,281 | A | | 3/1988 | Fleischer et al. | |
| 4,739,803 | A | * | 4/1988 | Borel | 139/383 A |
| 4,755,420 | A | | 7/1988 | Baker et al. | |
| 4,759,975 | A | | 7/1988 | Sutherland et al. | |
| 4,815,499 | A | * | 3/1989 | Johnson | 139/383 A |
| 4,815,503 | A | | 3/1989 | Borel | |
| 4,909,284 | A | | 3/1990 | Kositzke | |
| RE33,195 | E | | 4/1990 | McDonald et al. | |
| 4,934,414 | A | | 6/1990 | Borel | |
| 4,941,514 | A | | 7/1990 | Taipale | |
| 4,942,077 | A | | 7/1990 | Wendt et al. | |
| 4,945,952 | A | | 8/1990 | Vöhringer | |
| 4,967,805 | A | | 11/1990 | Chiu et al. | |
| 4,987,929 | A | | 1/1991 | Wilson | |
| 4,989,647 | A | | 2/1991 | Marchand | |
| 4,989,648 | A | | 2/1991 | Tate et al. | |
| 4,998,568 | A | | 3/1991 | Vohringer | |
| 4,998,569 | A | | 3/1991 | Tate | |
| 5,022,441 | A | | 6/1991 | Tate et al. | |
| 5,025,839 | A | | 6/1991 | Wright | |
| 5,067,526 | A | | 11/1991 | Herring | |
| 5,074,339 | A | | 12/1991 | Vohringer | |
| 5,084,326 | A | | 1/1992 | Vohringer | |
| 5,092,372 | A | | 3/1992 | Fitzka et al. | |
| 5,101,866 | A | | 4/1992 | Quigley | |
| 5,116,478 | A | | 5/1992 | Tate et al. | |
| 5,152,326 | A | | 10/1992 | Vohringer | |
| 5,158,118 | A | | 10/1992 | Tate et al. | |
| 5,219,004 | A | | 6/1993 | Chiu | |
| 5,228,482 | A | | 7/1993 | Fleischer | |
| 5,277,967 | A | | 1/1994 | Zehle et al. | |
| 5,358,014 | A | | 10/1994 | Kovar | |
| 5,421,374 | A | | 6/1995 | Wright | |
| 5,421,375 | A | | 6/1995 | Praetzel | |
| 5,429,686 | A | | 7/1995 | Chiu et al. | |
| 5,437,315 | A | | 8/1995 | Ward | |
| 5,449,026 | A | * | 9/1995 | Lee | 139/383 A |
| 5,454,405 | A | | 10/1995 | Hawes | |
| 5,456,293 | A | * | 10/1995 | Ostermayer et al. | 139/383 A |
| 5,465,764 | A | * | 11/1995 | Eschmann et al. | 139/383 A |
| 5,482,567 | A | | 1/1996 | Barreto | |
| 5,487,414 | A | * | 1/1996 | Kuji et al. | 139/383 A |
| 5,518,042 | A | | 5/1996 | Wilson | |
| 5,520,225 | A | | 5/1996 | Quigley et al. | |
| 5,542,455 | A | | 8/1996 | Ostermayer et al. | |
| 5,555,917 | A | | 9/1996 | Quigley | |
| 5,564,475 | A | | 10/1996 | Wright | |
| 5,641,001 | A | | 6/1997 | Wilson | |
| 5,651,394 | A | | 7/1997 | Marchand | |
| 5,709,250 | A | | 1/1998 | Ward et al. | |
| RE35,777 | E | | 4/1998 | Givin | |
| 5,746,257 | A | | 5/1998 | Fry | |
| 5,826,627 | A | | 10/1998 | Seabrook et al. | |
| 5,857,498 | A | | 1/1999 | Barreto et al. | |
| 5,881,764 | A | | 3/1999 | Ward | |
| 5,894,867 | A | | 4/1999 | Ward et al. | |
| 5,899,240 | A | | 5/1999 | Wilson | |
| 5,937,914 | A | | 8/1999 | Wilson | |
| 5,967,195 | A | | 10/1999 | Ward | |
| 5,983,953 | A | | 11/1999 | Wilson | |
| 6,073,661 | A | | 6/2000 | Wilson | |
| 6,112,774 | A | | 9/2000 | Wilson | |
| 6,123,116 | A | * | 9/2000 | Ward et al. | 139/383 A |
| 6,145,550 | A | | 11/2000 | Ward | |
| 6,148,869 | A | | 11/2000 | Quigley | |
| 6,158,478 | A | | 12/2000 | Lee et al. | |
| 6,179,965 | B1 | | 1/2001 | Cunnane et al. | |
| 6,202,705 | B1 | * | 3/2001 | Johnson et al. | 139/383 A |
| 6,207,598 | B1 | | 3/2001 | Lee et al. | |
| 6,227,255 | B1 | | 5/2001 | Osterberg et al. | |
| 6,237,644 | B1 | | 5/2001 | Hay et al. | |
| 6,240,973 | B1 | | 6/2001 | Stone et al. | |
| 6,244,306 | B1 | | 6/2001 | Troughton | |
| 6,253,796 | B1 | | 7/2001 | Wilson et al. | |
| 6,276,402 | B1 | | 8/2001 | Herring | |
| 6,379,506 | B1 | | 4/2002 | Wilson et al. | |
| 6,581,645 | B1 | | 6/2003 | Johnson et al. | |
| 6,585,006 | B1 | | 7/2003 | Wilson et al. | |
| 6,837,277 | B2 | | 1/2005 | Troughton et al. | |
| 6,896,009 | B2 | * | 5/2005 | Ward | 139/383 A |
| 6,959,737 | B2 | * | 11/2005 | Ward | 139/383 A |
| 7,001,489 | B2 | | 2/2006 | Taipale et al. | |
| 7,059,357 | B2 | * | 6/2006 | Ward | 139/348 |
| 7,059,361 | B1 | * | 6/2006 | Hansson | 139/383 A |
| 7,124,781 | B2 | * | 10/2006 | Fahrer et al. | 139/383 A |
| 7,195,040 | B2 | * | 3/2007 | Ward | 139/383 A |
| 7,426,943 | B2 | * | 9/2008 | Ueda et al. | 139/383 A |
| 2003/0010393 | A1 | | 1/2003 | Kuji | |
| 2004/0079434 | A1 | | 4/2004 | Martin et al. | |
| 2004/0102118 | A1 | | 5/2004 | Hay et al. | |
| 2004/0182464 | A1 | * | 9/2004 | Ward | 139/383 A |
| 2005/0121097 | A1 | * | 6/2005 | Ward | 139/383 A |
| 2006/0185753 | A1 | * | 8/2006 | Ward | 139/383 A |
| 2007/0157987 | A1 | * | 7/2007 | Ward | 139/383 A |

FOREIGN PATENT DOCUMENTS

| | | | |
|---|---|---|---|
| DE | 3318960 | A1 | 11/1984 |
| DE | 33 29 740 | A1 | 3/1985 |
| EP | 0 048 962 | B2 | 9/1981 |
| EP | 0 158 710 | A1 | 10/1984 |
| EP | 0 185 177 | B1 | 10/1985 |
| EP | 0 224 276 | B1 | 12/1986 |
| EP | 0 264 881 | B1 | 10/1987 |
| EP | 0 269 070 | B1 | 11/1987 |
| EP | 0 284 575 | B1 | 2/1988 |
| EP | 0 283 181 | B1 | 3/1988 |
| EP | 0 350 673 | B1 | 6/1989 |
| EP | 0 408 849 | A2 | 5/1990 |
| EP | 0 408 849 | A3 | 5/1990 |
| EP | 0 672 782 | B1 | 3/1995 |
| EP | 0 794 283 | A1 | 9/1997 |
| EP | 1 693 506 | A1 | 8/2006 |
| FR | 2 597 123 | | 4/1986 |
| GB | 2157328 | A | 10/1985 |
| GB | 2245006 | A | 2/1991 |
| JP | 8-158285 | | 12/1994 |
| WO | WO 86/00099 | A1 | 1/1986 |
| WO | WO 89/09848 | A1 | 4/1989 |
| WO | WO 99/61698 | A1 | 12/1999 |
| WO | WO 02/00096 | A2 | 1/2002 |
| WO | WO 03/010304 | A2 | 2/2003 |
| WO | WO 03/093573 | A1 | 11/2003 |

OTHER PUBLICATIONS

International Search Report for PCT/US2004/008311.

International Search Report for PCT Application No. PCT/US97/18629.

Rule 132 Declaration of Robert G. Wilson (Jun. 26, 1997).
Warren, C.A., "The Importance of Yarn Properties in Wet-End Wire Construction," Seminar, The Theory of Water Removal, Dec. 12, 1979.
European Search Report corresponding to application No. EP 05002306.8, dated Oct. 18, 2005.

* cited by examiner

WARPED STITCHED PAPERMAKER'S FORMING FABRIC

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

U.S. Pat. No. 6,896,009 and co-pending and co-assigned U.S. patent application Ser. No. 11/207,277, filed Aug. 18, 2005, describe a number of exemplary multi-layer forming fabrics that are "warped-stitched." In some instances such fabrics may be easier to manufacture than weft-stitched forming fabrics and/or may have desirable performance properties. However, there is still a demand for additional types of warp-stitched fabrics to meet the vast array of papermaking needs.

SUMMARY OF THE INVENTION

As a first aspect, embodiments of the present invention are directed to a papermaker's fabric comprising a plurality of repeat units of interwoven yarns, each repeat unit comprising: a set of top MD yarns; a set of top CMD yarns interwoven with the top MD yarns; a set of bottom MD yarns; and a set of bottom CMD yarns interwoven with the bottom MD yarns. In interweaving with the top CMD yarns, some of the top MD yarns include a segment in which the top MD yarn passes below a subset of three consecutive top CMD yarns. Each of the bottom MD yarns forms a knuckle over one of the three top CMD yarns of the subset that a top MD yarn located immediately thereabove passes below. The set of bottom CMD yarns includes at least twice as many yarns as does the set of bottom MD yarns.

As a second aspect, embodiments of the present invention are directed to a papermaker's fabric comprising a plurality of repeat units of interwoven yarns, each repeat unit comprising: a set of top MD yarns; a set of top CMD yarns interwoven with the top MD yarns; a set of bottom MD yarns; and a set of bottom CMD yarns interwoven with the bottom MD yarns. In interweaving with the top CMD yarns, some of the top MD yarns include a segment in which the top MD yarn passes below a subset of three consecutive top CMD yarns. Each of the bottom MD yarns forms a knuckle over one of the three top CMD yarns of the subset that a top MD yarn located immediately thereabove passes below. In interweaving with the bottom CMD yarn, the bottom MD yarns form machine side knuckles thereunder, the top CMD yarn that each bottom MD yarn passes over to form a knuckle is substantially centered between two machine side knuckles, and at least four bottom CMD yarns are positioned between the two machine side knuckles.

As a third aspect, embodiments of the present invention are directed to a method of making paper comprising the steps of: (a) providing a papermaker's fabric of the type described above, (b) depositing paper stock on the papermaker's fabric; and (c) removing moisture from the paper stock.

DETAILED DESCRIPTION OF EMBODIMENTS OF THE INVENTION

Figure 1:
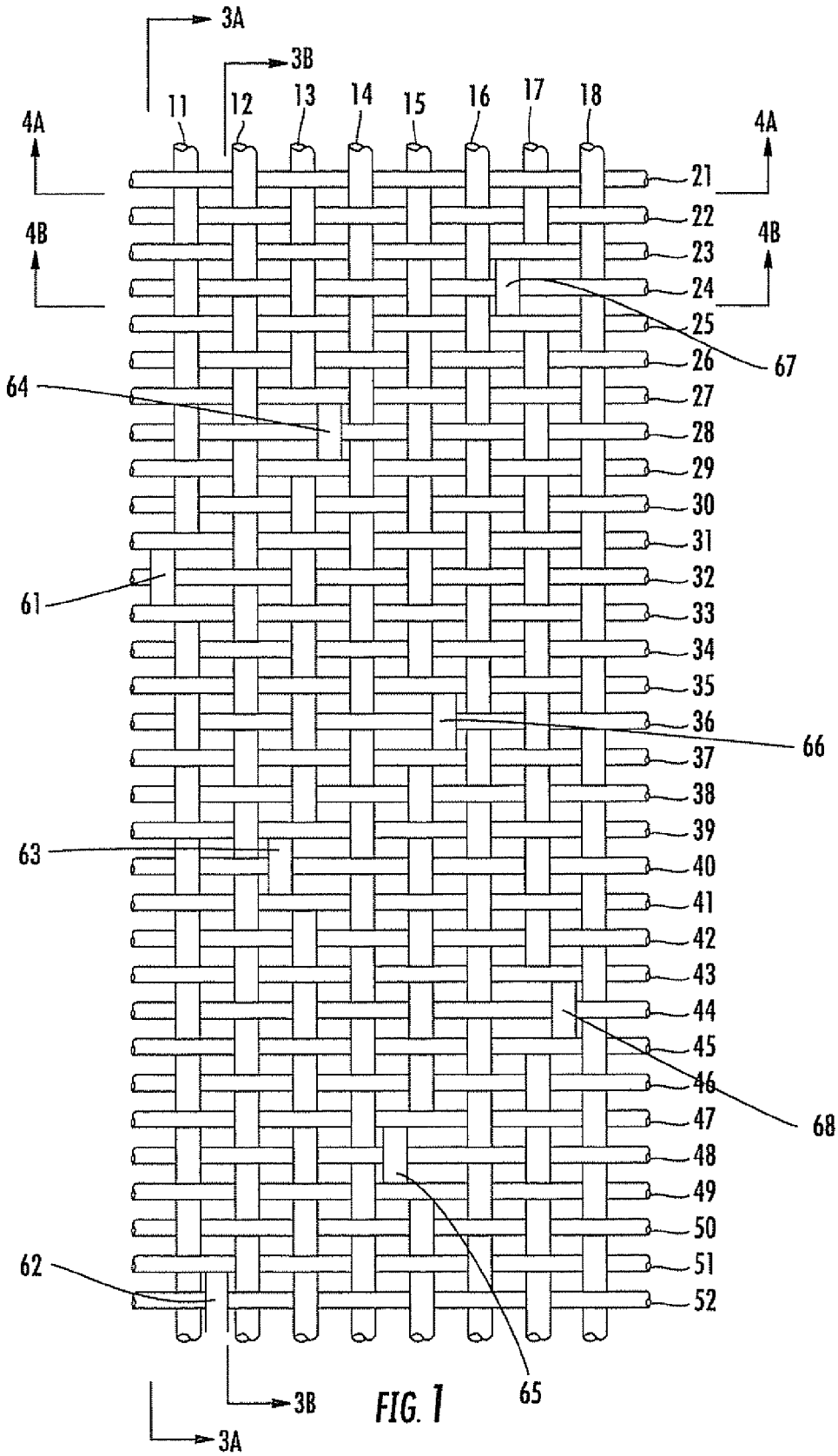
FIG. 1 is a top view of the top fabric layer of a papermaker's fabric according to embodiments of the invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Referring now to the drawings, a sixteen harness fabric, designated broadly at 10, is shown in FIGS. 1-4B. A repeat unit of the fabric 10 includes eight top MD yarns 11-18, thirty-two top CMD yarns 21-52, eight bottom MD yarns 61-68, and sixteen bottom CMD yarns 71-86. The weave pattern followed by these yarns is discussed below.

Figure 3A:
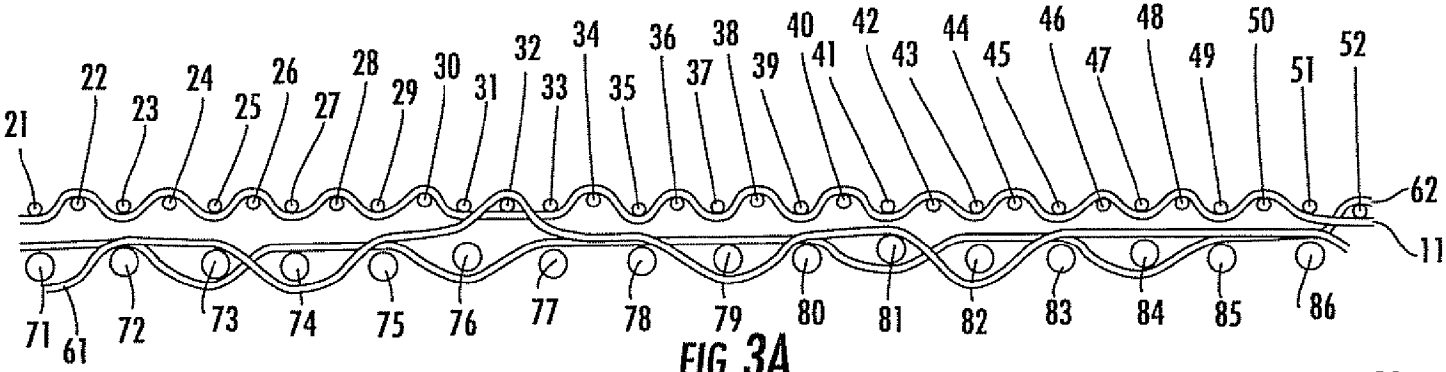
FIG. 3A is a section view of a typical odd-numbered top MD yarn and a typical pair of bottom MD yarns immediately adjacent the top MD yarn.
Figure 3B:
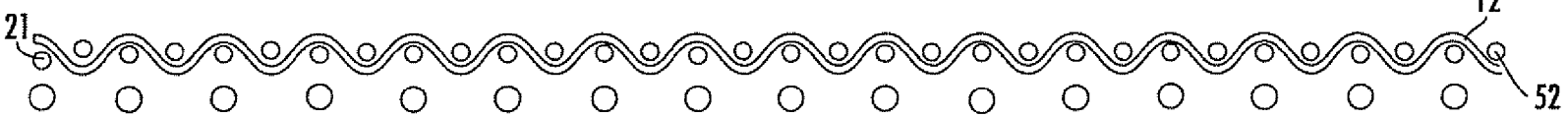
FIG. 3B is a section view of a typical even-numbered top MD yarn.

Turning first to FIGS. 1 and 3B, each of the even-numbered top MD yarns 12, 14, 16, 18 is interwoven with alternating top CMD yarns 21-52 in an "over 1/under 1" sequence, with each even-numbered top MD yarn 12, 14, 16, 18 passing over the same top CMD yarns. For example, top MD yarn 12 passes over top CMD yarn 21, under top CMD yarn 22, over top CMD yarn 23, and so on throughout the pattern. This pattern is followed by all of the even-numbered top MD yarns.

Looking now at FIGS. 1 and 3A, each of the odd-numbered top MD yarns 11, 13, 15, 17 weaves with the top CMD yarns 21-52 in an "over 1/under 1" sequence with the exception of two segments that pass under three top CMD yarns. For example, top MD yarn 11 passes above top CMD yarn 22, below top CMD yarn 23, above top CMD yarn 24, and so on until is reaches top CMD yarns 31-33, all of which it passes below. Top MD yarn 11 then continues by passing above top CMD yarn 34, below top CMD yarn 35, above top CMD yarn 36, and so on until it reaches top CMD yarns 51, 52 and 21, each of which it passes below. It can be seen, then, that each of the odd-numbered top MD yarns forms an "over 1/under 1" sequence with the top CMD yarns except for two locations in which a top knuckle formed by the top MD yarn is missing (this knuckle will be formed by a bottom MD yarn, as described below). This same pattern is followed by all of the odd-numbered top MD yarns, although the segments of three top CMD yarns below which the top MD yarn passes are offset from each other by eight top CMD yarns.

Figure 4B:
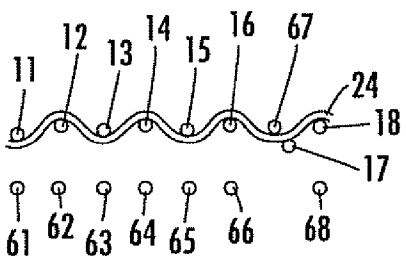
FIG. 4B is a section view of a typical top CMD yarn over which a bottom MD yarn stitches.
Figure 4A:
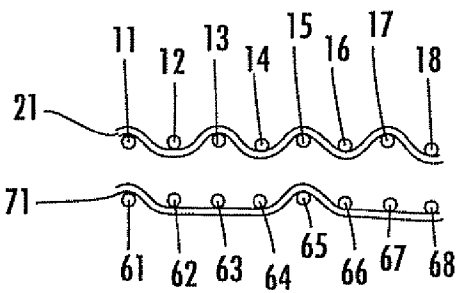
FIG. 4A is a section view of a typical top and bottom CMD yarn, wherein no bottom MD yarn stitches over the top CMD yarn.

Referring still to FIG. 1 and also to FIGS. 4A and 4B, it can be seen that most of the top CMD yarns 21-52 interweave with the top MD yarns in an "over 1/under 1" pattern. For example, top CMD yarn 21 passes over top MD yarn 11, under top MD yarn 12, over top MD yarn 13, and so on until it passes under top MD yarn 18 (see FIG. 4A). Every fourth top CMD yarn follows a similar "over 1/under 1" pattern with the top MD yarns with the exception of the segments in which the odd-numbered top MD yarns are missing a knuckle. For example, top CMD yarn 24 passes under top MD yarn 11, over top MD yarn 12, under top MD yarn 13 and so on until it reaches top MD yarns 16-18, all of which it passes over (note that top CMD yarn 24 passes under bottom MD yarn 67 to maintain the "over 1/under 1" type pattern on the top surface).

Figure 2:
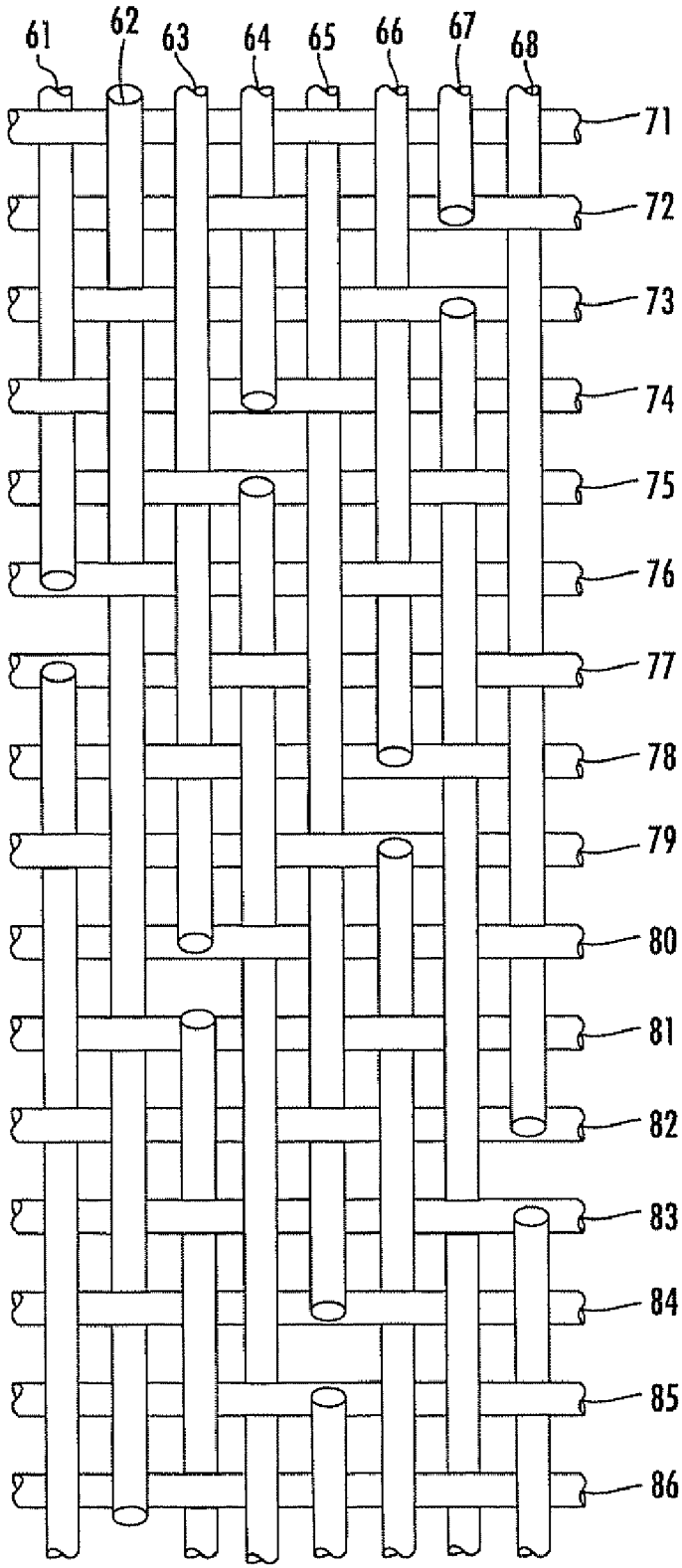
FIG. 2 is a top view of the bottom fabric layer of the papermaker's fabric of FIG. 1.

Turning now to FIG. 2, which illustrates the bottom layer of the fabric 10, each of the bottom MD yarns 61-68 interweaves with the bottom CMD yarns 71-86 in an "over 4/under 1/over 2/under 1" sequence that is repeated twice in the repeat unit. As an example, and referring to FIGS. 2 and 3A, bottom MD yarn 61 passes above bottom CMD yarns 75-78, below bottom CMD yarn 79, above bottom CMD yarns 80, 81, below bottom CMD yarn 82, above bottom CMD yarns 83-86, below bottom CMD yarn 71, above bottom CMD yarns 72, 73, and below bottom CMD yarn 74. Adjacent bottom MD yarns follow the same pattern with respect to the bottom CMD yarns, but are offset from one another such that a broken satin pattern is formed on the bottom surface of the bottom layer. Because the repeat unit of the bottom layer includes twice as many bottom CMD yarns as bottom MD yarns, the bottom layer can be referred to as an "N×2N" bottom layer.

Looking still at FIG. 2, and also at FIGS. 1 and 3A, each of the bottom CMD yarns also stitches once with a top CMD yarn. The location of the stitching point is determined by the location of the three consecutive CMD yarns that the odd-numbered top MD yarn nearest to the bottom MD yarn passes below. For example, top MD yarn 11 has two different segments that pass below three consecutive top CMD yarns: top CMD yarns 31-33; and top CMD yarns 51, 52 and 21. In each instance, the bottom MD yarns located immediately adjacent to top MD yarn 11 form a knuckle over the second of the three consecutive top CMD yarns of each segment. More specifically, bottom MD yarn 61 forms a knuckle over top CMD yarn 32, and bottom MD yarn 62 forms a knuckle over top CMD yarn 52. By forming top knuckles in this manner, the bottom MD yarns 61, 62 replace the knuckles skipped by the top MD yarn 11 located immediately adjacent to complete the "over 1/under 1" sequence followed by the remainder of the top MD yarn 11. The remaining bottom MD yarns 63-68 form one knuckle each in the locations where odd-numbered top MD yarns have segments that pass under three consecutive top CMD yarns.

Looking now at FIGS. 2 and 4A, each of the bottom CMD yarns 71-86 interweaves with the bottom MD yarns 61-68 in an "under 3/over 1" sequence repeated twice in the repeat unit. For example, bottom CMD yarn 71 passes under bottom MD yarns 62-64, over bottom MD yarn 65, under bottom MD yarns 66-68, and under bottom MD yarn 61. The remaining bottom CMD yarns follow a similar pattern with respect to the bottom MD yarns.

The fabric 10 can provide certain performance benefits as compared to prior fabrics. One benefit is a higher permeability in the fabric, particularly for fabrics that include fine yarns. As the diameter of yarns decreases (which may be desirable in order to reduce marking on the paper stock applied to the fabric), the mesh of the fabric can become more dense, which can decrease the permeability of the fabric. Also, the stitching points themselves can decrease permeability. By employing a fabric with fewer stitching points per repeat unit than prior fabrics (which can be done with an N×2N bottom layer), the permeability can remain at acceptable or even increased levels, even with fine yarns.

Another benefit that can be achieved with fabrics of the present invention is a lack of edge curl in the fabric. In prior fabrics, the inclusion of four different types of MD yarns (typical top MD yarns, top MD yarns with a "dropped" knuckle", non-stitching bottom MD yarns, and stitching bottom MD yarns) meant that four different "crimps" needed to be coupled in the fabric. Balancing these different crimps was difficult and typically resulted in a fabric with edge curl. However, in the fabric 10, there are only three different types of MD yarns (as the fabric 10 has no non-stitching MD yarns), so balancing the crimp becomes more manageable.

Figure 5:
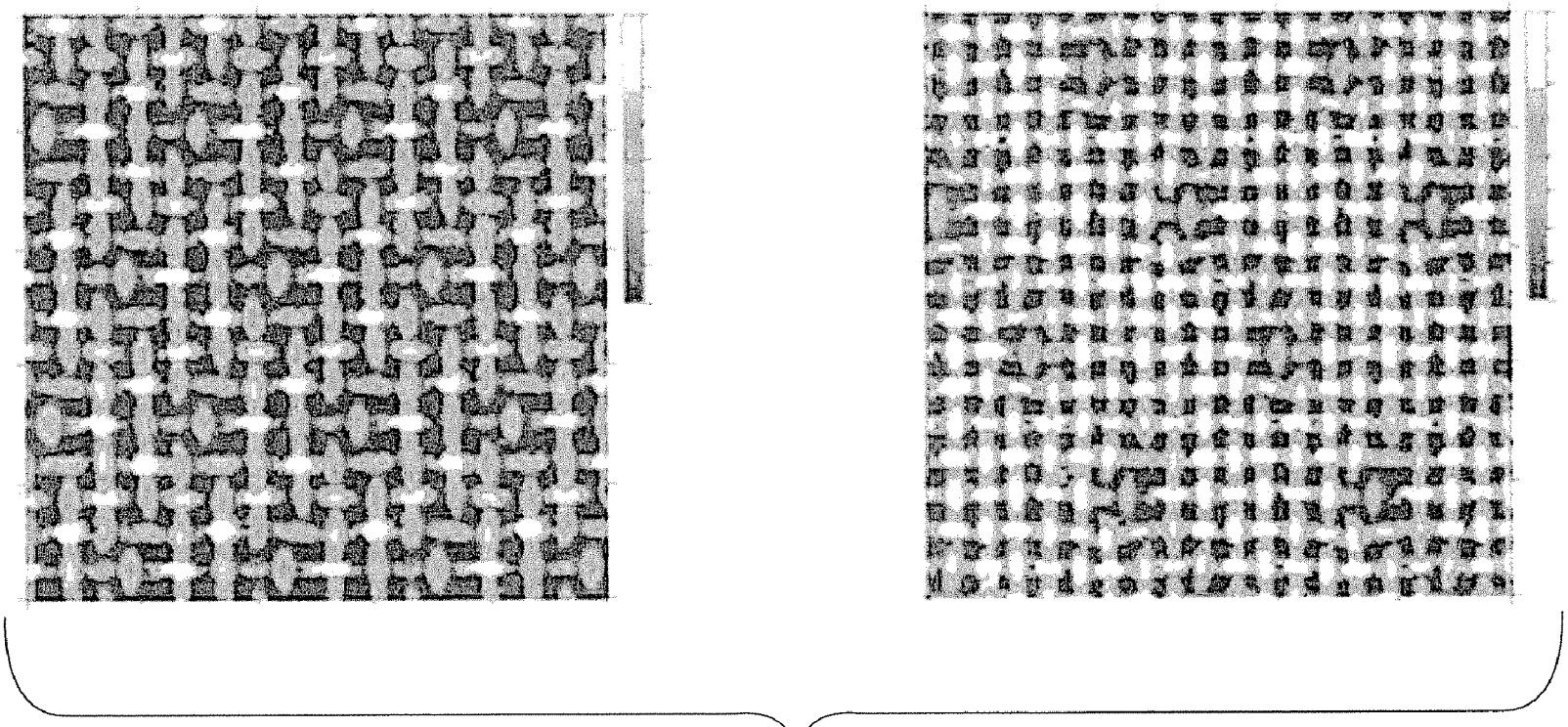
FIG. 5 is a topographical projection showing the surface topography of a fabric of the present invention compared to a prior fabric.

Also, it should be noted that the bottom MD yarns stitch over a top CMD yarn that is substantially centered between bottom MD knuckles formed by the bottom MD yarns below bottom CMD yarns. For example, and referring to FIGS. 2 and 3A, the bottom MD yarn 61 forms knuckles under the bottom CMD yarns 74 and 79. The top CMD yarn 32 is substantially centered between these two bottom CMD yarns, inasmuch as it is located above and between bottom CMD yarns 76 and 77. Locating the stitching knuckle in this position in a fairly long segment of the bottom MD yarn can reduce the tensile force applied by the stitching knuckle on the top CMD yarn it passes over, such that the knuckle more closely resembles the knuckles formed by the top MD yarns over the top CMD yarns, thereby improving the surface topography of the fabric (see FIG. 5 for a comparison to a prior fabric disclosed in U.S. Pat. No. 6,896,009 referenced above).

Those skilled in this art will appreciate that fabrics of other weave patterns may also be employed. For example, although a sixteen harness fabric is illustrated and described herein, fabrics of twelve, twenty, twenty-four or more harnesses can also be envisioned. Moreover, different numbers of CMD yarns may be employed. Also, in the illustrated embodiment, there are twice as many top CMD yarns as bottom CDM yarns; however, in some embodiments this ratio may differ; as an example, in some embodiments equal numbers of top and bottom CMD yarns may be employed.

In addition, although in the fabric 10 equal numbers of top MD yarns with and without segments of "missing top knuckles" are included, in some embodiments a higher or lower ratio of top MD yarns with and without segments of missing top knuckles may be included; also, in the fabric 10, the yarns with segments of missing top knuckles alternate with yarns that have no such segments, but in other embodiments yarns with such segments may not alternate with yarns without such segments. An another alternative, each of the bottom MD yarns may stitch with more than one top CMD yarn, and/or each of the bottom MD yarns may form more or fewer than four knuckles below bottom CMD yarns.

Further, although a plain weave top surface is shown herein, other weave patterns, such as twills and satins, may also be used. Also, different bottom weave patterns may be used as desired.

The fabrics pictured and otherwise described and claimed herein may be employed in a variety of applications, including forming fine paper grades, tissue paper, brown paper and newsprint, but is especially beneficial for fine paper, newsprint and brown paper applications.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, the diameter of the top CMD yarns and all of the MD yarns is between about 0.10 and 0.25 mm, and the diameter of the bottom CMD yarns is between about 0.20 and 0.50 mm. Those of skill in the art will appreciate that yarns having diameters outside the above ranges may be used in certain applications. In one embodiment of the present invention, the top CMD yarns and all of the MD yarns have diameters between about 0.15 and 0.17 mm, and the diameter of the bottom CMD yarns is between about 0.25 and 0.40 mm to provide fabrics with a target top mesh of 75×75 yarns per inch. Fabrics employing these yarn sizes may be implemented with polyester yarns or a combination of polyester and nylon yarns. An exemplary embodiment of the fabric 10 is set forth in Table 1.

TABLE 1

| Yarn Type | Size (mm) | Material |
|---|---|---|
| Top MD | 0.15 | polyester |
| Top CMD | 0.13 | polyester |
| Bottom MD | 0.15 | polyester |
| Bottom CMD | 0.25 | polyester |

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention will not be provided herein.

The foregoing embodiments are illustrative of the present invention, and are not to be construed as limiting thereof. The invention is defined by the following claims, with equivalents of the claims to be included therein.

That which is claimed is:

1. A papermaker's fabric comprising a plurality of repeat units of interwoven yarns, each repeat unit comprising:

a set of top machine direction (MD) yarns;

a set of top cross machine direction (CMD) yarns interwoven with the top MD yarns;

a set of bottom MD yarns;

a set of bottom CMD yarns interwoven with the bottom MD yarns;

wherein, in interweaving with the top CMD yarns, some of the top MD yarns include a segment in which the top MD yarn passes below a subset of three consecutive top CMD yarns; and wherein each of the bottom MD yarns forms a knuckle over one of the three top CMD yarns of the subset that a top MD yarn located immediately thereabove passes below; and wherein, in interweaving with the bottom CMD yarn, the bottom MD yarns form machine side knuckles thereunder and the top CMD yarn that each bottom MD yarn passes over to form a knuckle is substantially centered between two machine side knuckles; and wherein at least four bottom CMD yarns are positioned between the two machine side knuckles.

2. The papermaker's fabric defined in claim 1, wherein each of the bottom MD yarns forms a knuckle over the second of the three consecutive CMD yarns in the subset.

3. The papermaker's fabric defined in claim 1, wherein a first subset of the set of top MD yarns that includes a segment in which the top MD yarn passes below a subset of three consecutive top CMD yarns comprises exactly one-half of the top MD yarns, and a second subset of the set of top MD yarns that does not include a segment in which the top MD yarn passes below a subset of three consecutive top CMD yarns comprises exactly one-half of the top MD yarns.

4. The papermaker's fabric defined in claim 3, wherein the top MD yarns of the first subset and the top MD yarns of the second subset are alternately arranged in the repeat unit.

5. The papermaker's fabric defined in claim 1, wherein the top MD yarns, the top CMD yarns, and the knuckles formed by the bottom MD yarns over top CMD yarns combine to form a plain weave pattern.

6. The papermaker's fabric defined in claim 1, wherein each of the bottom MD yarns passes over only one top CMD yarn.

7. The papermaker's fabric defined in claim 1, wherein some of the top MD yarns include two segments, each of which passes under a subset of three consecutive top CMD yarns.

8. The papermaker's fabric defined in claim 1, wherein the bottom MD yarns are interwoven with the bottom CMD yarns in an "over 4/under 1/over 2/under1" pattern.

* * * * *